US007064720B2

(12) United States Patent
Yoshino

(10) Patent No.: US 7,064,720 B2
(45) Date of Patent: Jun. 20, 2006

(54) EARPHONE ANTENNA

(75) Inventor: Yoshitaka Yoshino, Tokyo (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 11/192,577

(22) Filed: Jul. 29, 2005

(65) Prior Publication Data

US 2006/0028383 A1 Feb. 9, 2006

(30) Foreign Application Priority Data

Aug. 3, 2004 (JP) ..... P2004-227095
Jun. 8, 2005 (JP) ..... P2005-167725

(51) Int. Cl.
*H01Q 1/24* (2006.01)
*H01Q 1/12* (2006.01)

(52) U.S. Cl. ..... 343/702; 343/718; 343/90.6

(58) Field of Classification Search ..... 343/702, 343/718, 906, 900, 904, 905; H01Q 1/24, H01Q 1/12
See application file for complete search history.

(56) References Cited

U.S. PATENT DOCUMENTS 5,757,332 A * 5/1998 Hanaoka et al. ..... 343/787
6,356,773 B1 * 3/2002 Rinot ..... 455/575.1
2003/0160725 A1 * 8/2003 Baxter et al. ..... 343/702
2004/0142676 A1 7/2004 Sim et al.
2006/0014560 A1 * 1/2006 Yoshino ..... 455/550.1

FOREIGN PATENT DOCUMENTS

| | | | |
|---|---|---|---|
| GB | 2 380 861 | A | 4/2003 |
| JP | 59-89004 | A | 5/1984 |
| JP | 07-298384 | A | 11/1995 |
| JP | 2003-163529 | A | 6/2003 |
| JP | 2005-064742 | A | 3/2005 |

* cited by examiner

*Primary Examiner*—Hoanganh Le
(74) *Attorney, Agent, or Firm*—Lerner, David, Littenberg, Krumholz & Mentlik, LLP

(57) ABSTRACT

An earphone antenna has an earphone unit including an earphone, an earphone cable for supplying audio signals to the earphone, and a first pin jack connector portion on one end of the earphone cable, the earphone cable functioning as an antenna wire. The earphone antenna further includes a shielded cable having a coaxial core, an insulation-covered signal wire for audio signals, and a ground wire. The coaxial core has a center conductor for transmitting high frequency signals surrounded by an insulator and further surrounded by a shield wire. A multi-pole connector arranged on one end of the shielded cable is adapted to electrically connect the shielded cable to an electronic apparatus. A connection block connects the other end of the shielded cable to the earphone unit, the connection block including a circuit device for separating audio signals and high frequency signals, and a second pin jack connector portion for removably receiving the first pin jack connector portion to removably connect the earphone unit to the connection block.

5 Claims, 7 Drawing Sheets

EARPHONE ANTENNA

CROSS-REFERENCE TO RELATED APPLICATIONS

The present application claims priority from Japanese Application Nos. 2004-227095 filed Aug. 3, 2004 and 2005-167725 filed Jun. 8, 2005, the disclosures of which are hereby incorporated by reference herein.

BACKGROUND OF THE INVENTION

The present invention relates to an earphone antenna for portable wireless equipment worn on the human body during use.

Portable wireless equipment worn on the human body during use, such as a pager, a radio receiver or a liquid crystal television receiver, has heretofore used an earphone antenna which uses, as an antenna, signal wires for transmitting audio signals to a rod antenna and earphones (Japanese Patent Application Publication No. 2003-163529).

However, the portable wireless equipment using a rod antenna or an earphone antenna has drawbacks that when the equipment is used in the state of being worn on the human body, the performance of the antenna is remarkably degraded due to the wear of the equipment on the human body, so that it is difficult to obtain satisfactory reception sensitivity in the case of television broadcasting which handles signals containing a large amount of information such as video images.

In particular, the earphone antenna which uses, as an antenna, signal wires for transmitting audio signals to earphones has a drawback that since the earphones or the signal wires come in direct contact with the human body, the human body greatly influences the wireless equipment through the antenna and greatly impairs stability of reception.

Television broadcasting in Japan, for example, uses the VHF band of 90–108 MHz (1–3 ch) and 170–222 MHz (4–12 ch) and the UHF band of 470–770 MHz (13–62 ch). Accordingly, liquid crystal television receivers for receiving television broadcasting need to receive high frequency signals over an extremely wide band of 90–770 MHz, but the existing rod antenna and earphone antennas are inferior in performance to fixed types of antennas and have extreme difficulty in obtaining satisfactory sensitivity in the necessary frequency range.

In addition, the existing earphone antennas are remarkably low in sensitivity because they make use of ordinary earphones, or have a special structure in which a separate antenna wire is inserted between signal wires of earphones, or have an unremovable structure because of integral molding.

The present invention has been made in view of the above-mentioned drawbacks, and intends to provide an earphone antenna able to alleviate the influence of the human body and ensure stability of reception as well as to use replaceable earphone units.

SUMMARY OF THE INVENTION

To solve the above-mentioned problems, according to one embodiment of the present invention, there is provided an earphone antenna. The earphone antenna includes an earphone unit including an earphone, an earphone cable for supplying audio signals to the earphone, and a first pin jack connector portion on one end of the earphone cable, the earphone cable functioning as an antenna wire; a shielded cable including a coaxial core, an insulation-coated signal wire for audio signals, and a ground wire, the coaxial core having a center conductor for transmitting high frequency signals surrounded by an insulator and further surrounded by a shield wire; a multiple-pole connector arranged on one end of the shielded cable and adapted to electrically connect the shielded cable to an electronic apparatus; and a connection block for connecting the other end of the shielded cable to the earphone unit, the connection block including a circuit device for separating audio signals and high frequency signals, and a second pin jack connector portion for removably receiving the first pin jack connector portion to removably connect the earphone unit to the connection block.

In the earphone antenna according to the embodiment of the present invention, an antenna device may be provided in the connection block so that the earphone antenna functions as an antenna even when the earphone unit is disconnected from the connection block.

In the earphone antenna according to the embodiment of the present invention, instead of the earphone unit, a speaker may be connected to the connection block via the pin jack connector portions.

In the earphone antenna according to the embodiment of the present invention, instead of the earphone unit, a rod antenna may be connected to the connection block via the pin jack connector portions.

In the earphone antenna according to the embodiment of the present invention, the first and second pin jack connector portions together define a pin jack connector, the pin jack connector including a switch for opening a circuit in conjunction with an action of connecting the first pin jack connector portion to the second pin jack connector portion, and for closing the circuit in conjunction with an action of disconnecting the first pin jack connector portion from the second pin jack connector portion.

In accordance with the earphone antenna according to the embodiment of the present invention described above, the influence of the human body can be alleviated to ensure the stability of reception. In addition, the pin jack connector portion to which the earphone cable is removably connected is provided in the connection block so that the earphone unit may be removed therefrom. Accordingly, the earphone unit is replaceable, so that ordinary earphones can be used. In addition, in the earphone antenna according to the embodiment of the present invention, instead of the earphone unit, a speaker or a rod antenna can be connected to the connection block via the pin jack connector portions.

Accordingly, in accordance with the embodiment of the present invention, it is possible to provide an earphone antenna able to alleviate the influence of the human body and ensure the stability of reception as well as to use replaceable earphone units.

BRIEF DESCRIPTION OF THE DRAWINGS

The present invention will become more readily appreciated and understood from the following detailed description of a embodiment of the present invention when taken in conjunction with the accompanying drawings, in which.

DETAILED DESCRIPTION

An embodiment of the present invention will be described below in detail with reference to the accompanying drawings. It goes without saying, however, that the present invention is not limited to the following embodiment and can be arbitrarily modified without departing from the scope and spirit of the present invention.

Figure 1:
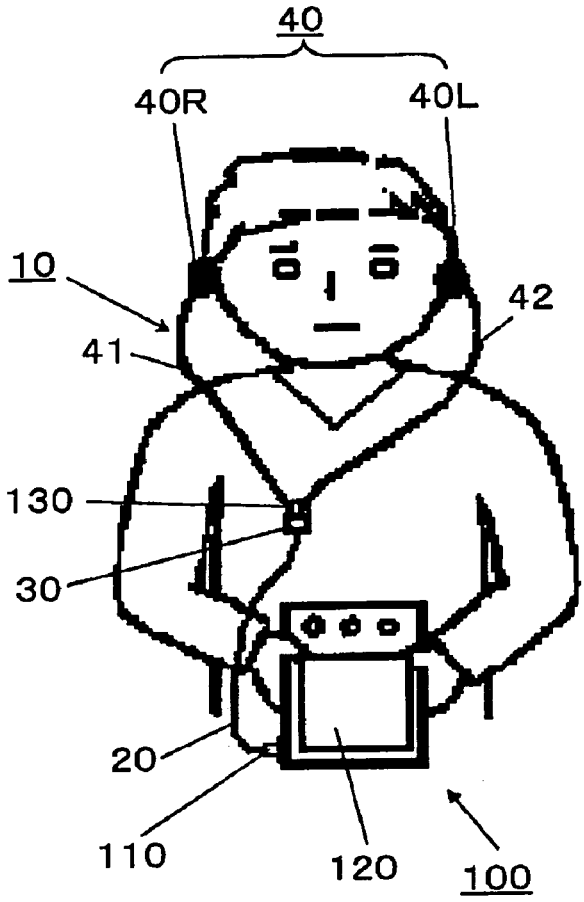
FIG. 1 is a schematic view showing a configuration of a liquid crystal television receiver to which an embodiment of the present invention is applied.

The present invention is applied to a liquid crystal television receiver 100 having the configuration shown in FIG. 1 by way of example.

In the liquid crystal television receiver 100 shown in FIG. 1, an earphone antenna 10 according to the embodiment of the present invention is connected to a receiver body 120 via a pin jack connector 110.

The earphone antenna 10 includes a shielded cable 20 connected at one end to the receiver body 120 via the 5-pole pin jack connector 110, a connection block 30 connected to the other end of the shielded cable 20, and an earphone unit 40 equipped with stereo earphones 40R and 40L each provided at one end of a respective one of two earphone cables 41 and 42 connected to the connection block 30 via a pin jack connector 130.

Figure 2:
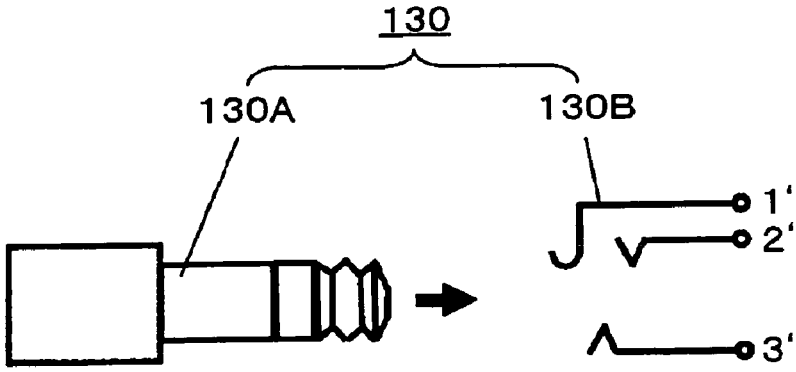
FIG. 2 is a schematic view showing a configuration of a pin jack connector which connects an earphone unit to an earphone antenna of the liquid crystal television receiver.

The pin jack connector 130 includes, as shown in FIG. 2, a pin 130A and a jack 130B each having three poles to which three kinds of lines, i.e., an audio L channel (L), an audio R channel (R) and ground (Gnd), are to be connected, respectively.

Figure 3:
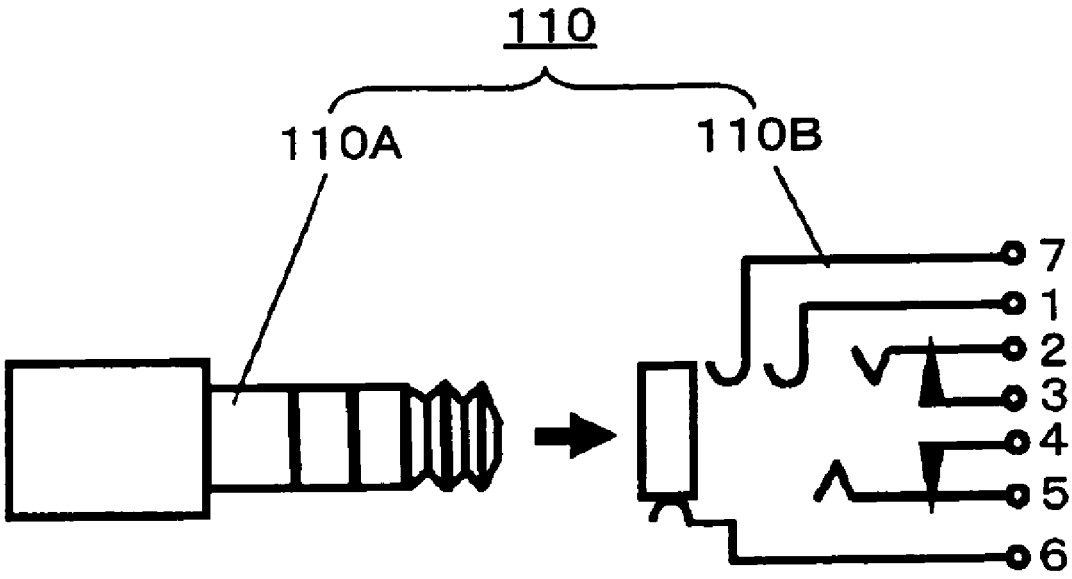
FIG. 3 is a schematic view showing a configuration of a pin jack connector which connects a receiver body and the earphone antenna in the liquid crystal television receiver.

The pin jack connector 110 includes, as shown in FIG. 3, a pin 110A and a jack 110B each having five poles to which five kinds of lines, i.e., an antenna (Ant), a headphone detection line (detection), the audio L channel (L), the audio R channel (R) and the ground (Gnd), are to be connected, respectively.

Figure 4:
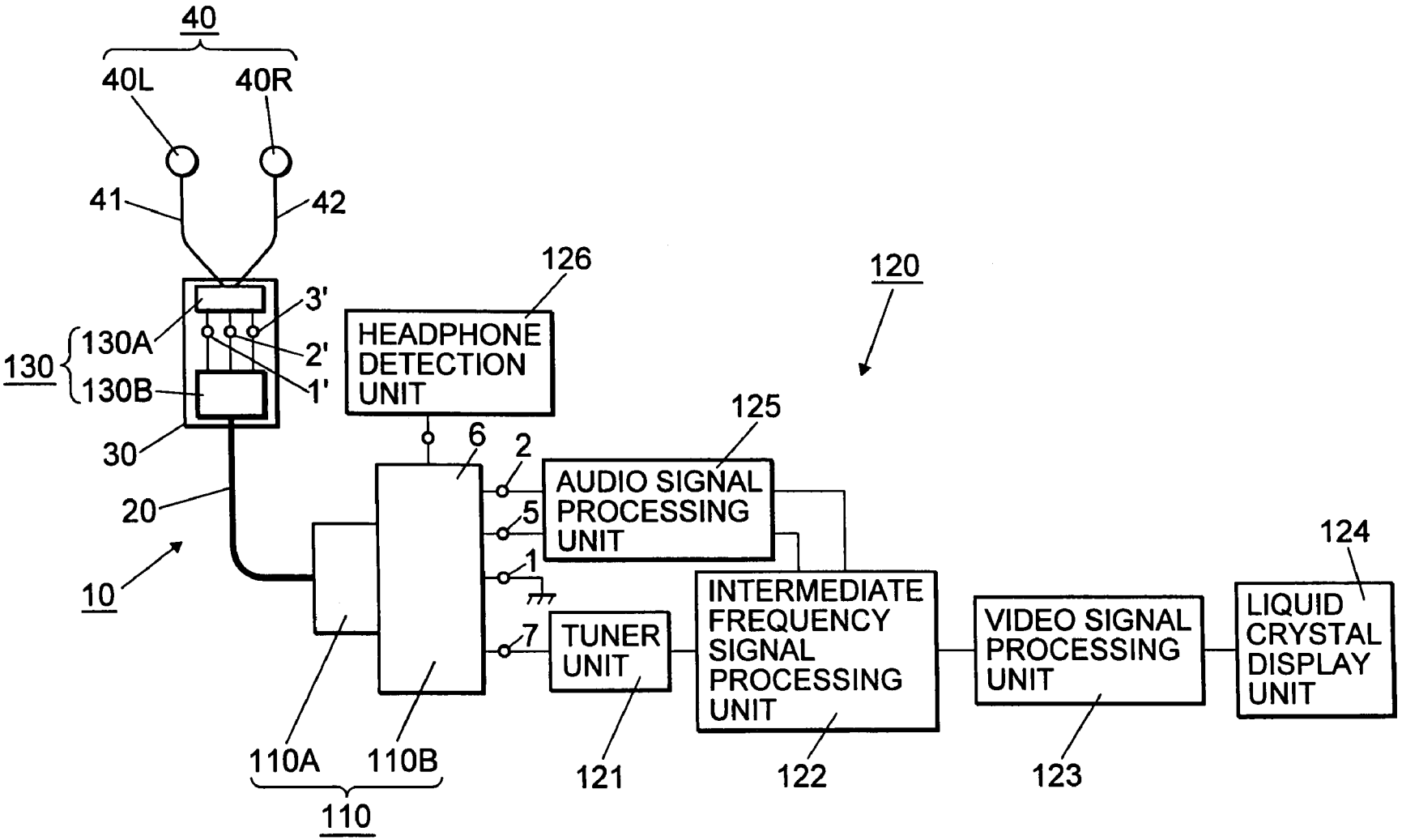
FIG. 4 is a block diagram showing a configuration of the receiver body.

The receiver body 120 includes, as shown in FIG. 4, a tuner unit 121, an intermediate frequency signal processing unit 122 connected to the tuner unit 121, a video signal processing unit 123 and an audio signal processing unit 125 both of which are connected to the intermediate frequency signal processing unit 122, a liquid crystal display unit 124 connected to the video signal processing unit 123, and the jack 110B constituting the pin jack connector 110.

In the liquid crystal television receiver 100, the jack 110B is, as shown in FIG. 3, equipped with five movable terminals 1, 2, 5, 6 and 7 and two fixing terminals 3 and 4, and as shown in FIG. 4, the movable terminal 7 is connected to the tuner unit 121 as an antenna terminal (Ant), while the movable terminals 2 and 5 are connected to the audio signal processing unit 125 as the audio L channel terminal (L) and the audio R channel terminal (R), respectively. The movable terminal 6 is connected to a headphone detection unit 126 as a headphone detection terminal. The movable terminal 1 is connected to GND of a circuit board of the wireless equipment body as a common ground terminal (Gnd) of the wireless equipment. The fixing terminals 3 and 4 are terminals for fixing the pin 110A in position.

Although not shown, a capacitor having a capacitance of approximately 1,000 pF is generally inserted between the movable terminal 7 and the tuner unit 121 in order to prevent electrostatic discharge damage.

Figure 5:
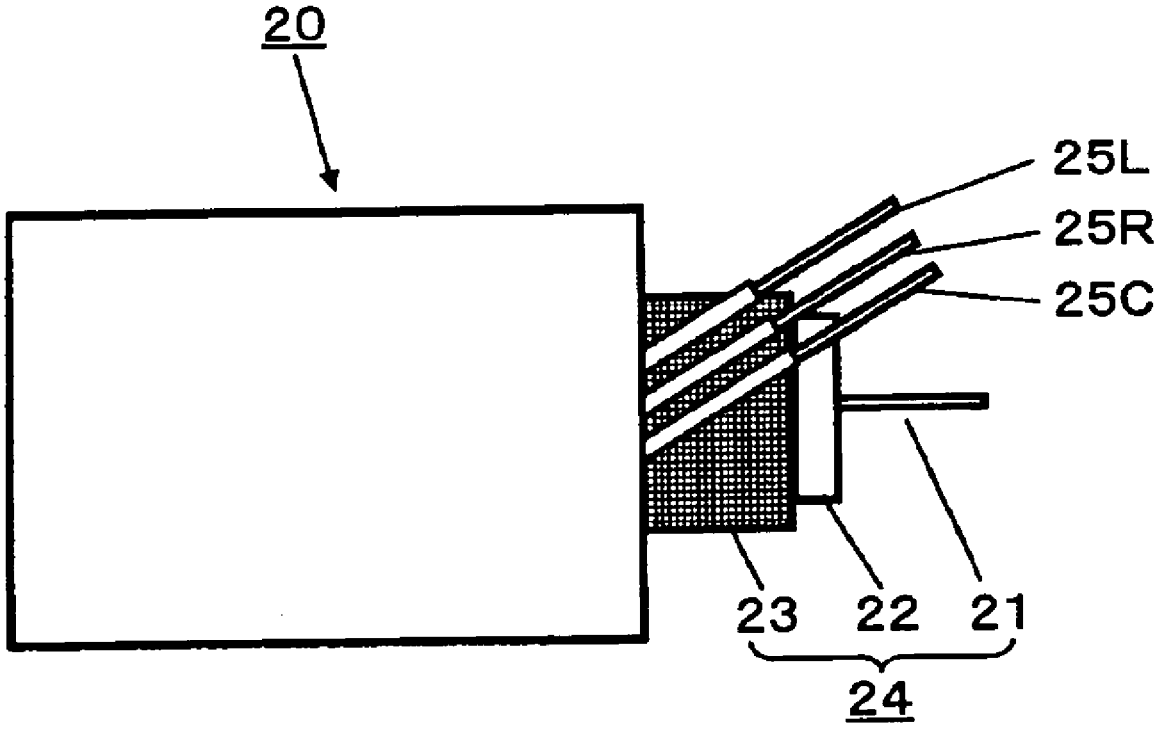
FIG. 5 is a schematic view showing a structure of a shielded cable constituting part of the earphone antenna.

As shown in FIG. 5, the shielded cable 20 includes a coaxial core 24, insulator-covered signal wires 25L and 25R for audio signals, and an insulator-covered headphone-detecting signal wire 25C. The coaxial core 24 has a center conductor 21 extended to transmit high frequency signals and covered with an insulator 22 and further with a shield wire 23, and the signal wires 25L and 25R and the headphone-detecting signal wire 25C are wound around the coaxial core 24 and an insulating jacket covers the outside of the wound wires 25L, 25R and 25C. The shielded cable 20 at one end is provided with the pin 110A having five poles respectively connected to the center conductor 21 and the shield wire 23 of the coaxial core 24, the signal wires 25L and 25R for audio signals, and the headphone-detecting signal wire 25C. The shielded cable 20 at the other end is provided with the connection block 30 which is connected to the center conductor 21, the shield wire 23, the signal wires 25L and 25R for audio signals, and the headphone-detecting signal wire 25C.

Figure 6:
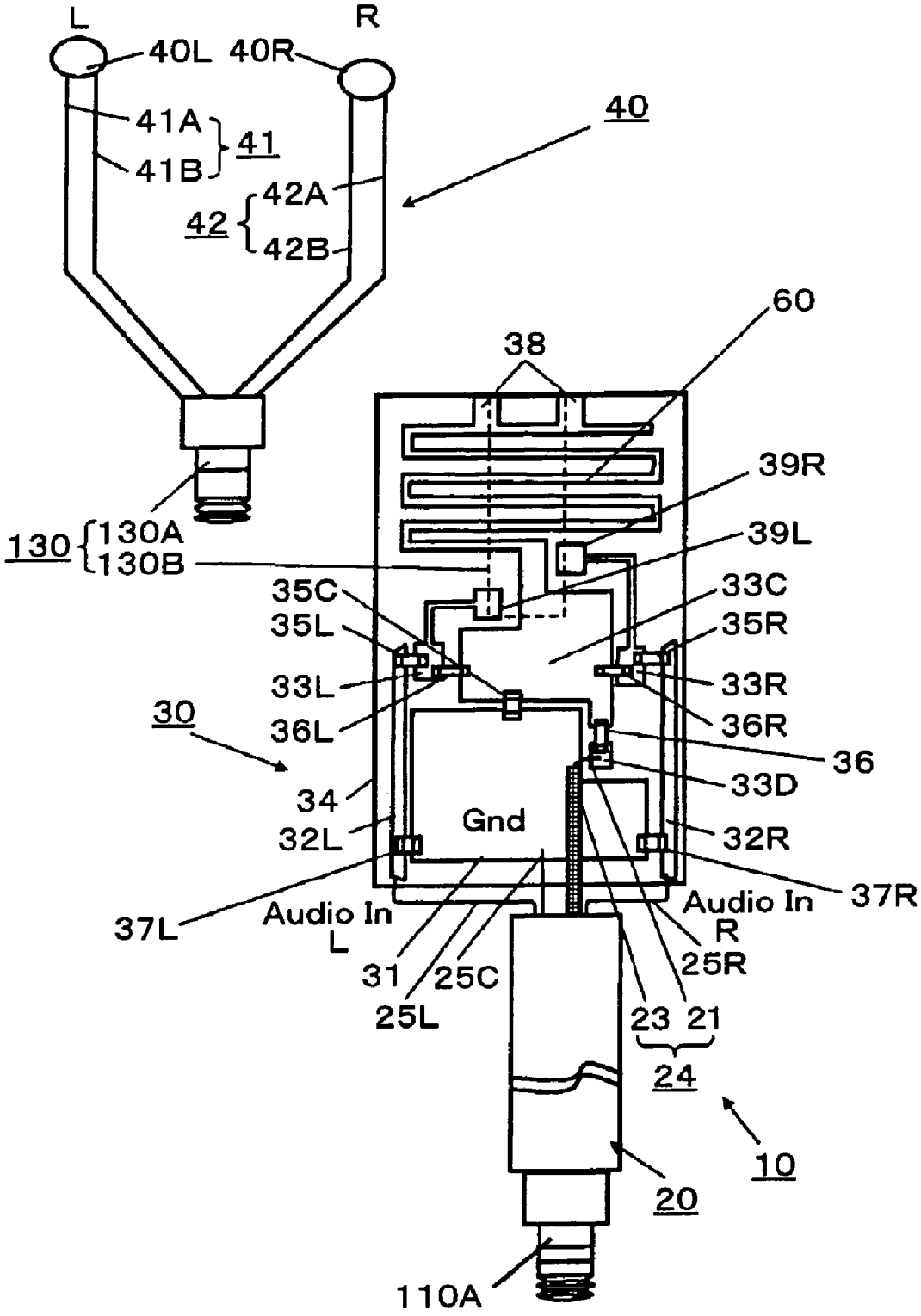
FIG. 6 is a schematic view showing a configuration of a connection block constituting part of the earphone antenna.

The connection block 30 is, as shown in FIG. 6, equipped with a circuit board 34 on which are formed a ground pattern 31 provided at the central location, stereo-audio-signal transmission line patterns 32L and 32R respectively provided on the both sides of the ground pattern 31, three connection lands 33L, 33R and 33C provided on an extending-end side of the ground pattern 31, and a connection land 33D provided on one side of the ground pattern 31. Mounted on the circuit board 34 are high frequency chokes 35L and 35R which respectively connect extending-end portions of the stereo-audio-signal transmission line patterns 32L and 32R to the connection lands 33L and 33R, a high frequency choke 35C which connects the connection land 33C to the connection land 33C, a chip capacitor 36L which connects the connection land 33L and the connection land 33C, a chip capacitor 36R which connects the connection land 33R and the connection land 33C, and a chip capacitor 36 which connects the connection land 33C and the connection land 33D.

The stereo-audio-signal transmission line patterns 32L and 32R formed on the circuit board 34 are connected to the ground pattern 31 via chip capacitors 37L and 37R, respectively, so that the transmission line patterns 32L and 32R can be integrated with the ground (Gnd) on a high-frequency basis.

The jack 130B of the pin jack connector 130 is, as shown in FIG. 2, equipped with an L terminal 2' to which the audio L channel (L) is to be connected, an R terminal 3' to which the audio R channel (R) is to be connected, and a ground terminal 1' for the ground (Gnd).

Figure 7:
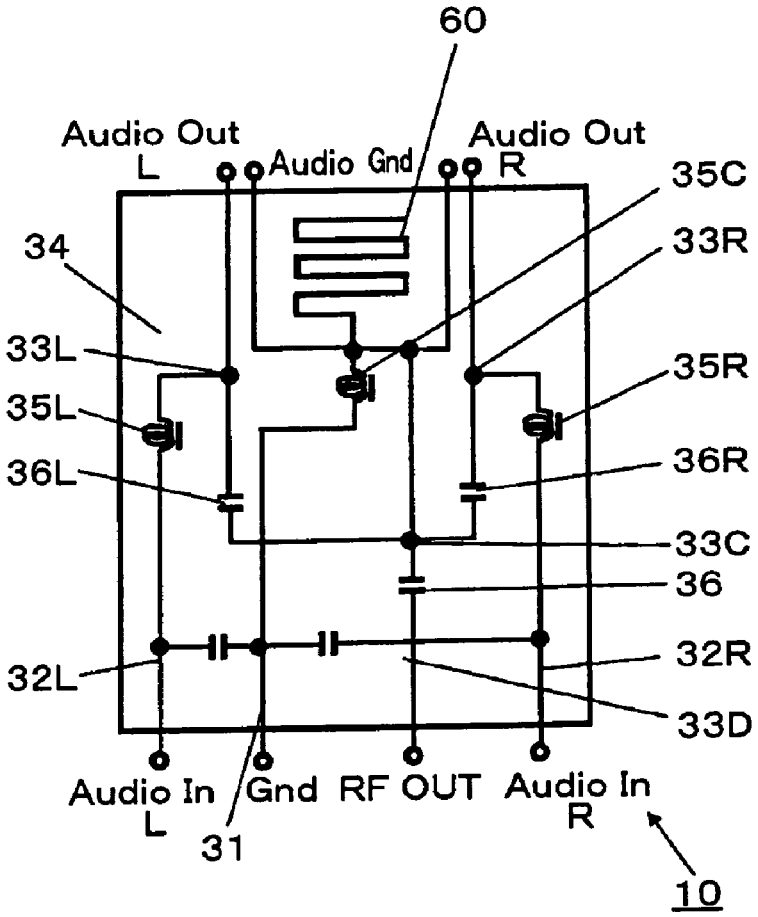
FIG. 7 is a circuit configuration diagram showing an electrical configuration of the earphone antenna.

The connection block 30 is provided with the connector jack 130B in order to transmit audio signals, and as shown in FIGS. 6 and 7, the land 33L connected to the left transmission line pattern 32L by the high frequency choke 35L and an L land 39L to which the L terminal 2' of the connector jack 130B is fixed are connected to each other in order to supply left audio signals to the left earphone 40L. In addition, the land 33R connected to the right transmission line pattern 32R by the high frequency choke 35R and an R land 39R to which the R terminal 3' of the connector jack 130B are connected to each other in order to supply right audio signals to the right earphone 40R. The connection land 33C which serves as ground for both earphones 40L and 40R and a ground land 38 to which the ground terminal 1' of the connector jack 130B are connected to each other. The connection land 33C serves as an antenna for high frequencies, and as shown in FIGS. 6 and 7, a meander-shaped pattern 60 is formed to extend from the connection land 33C so that the connection land 33C functions as an antenna even when the connector pin 130A of the earphone unit 40 is removed from the connection block 30.

An electrical circuit configuration formed on the connection block 30 is shown in FIG. 7.

The shielded cable 20 is connected to the connection block 30 in the following manner.

The left audio signal wire 25L and the right audio signal wire 25R of the shielded cable 20 are respectively connected to the stereo-audio-signal transmission line patterns 32L and 32R formed on the circuit board 34, and the headphone-detecting signal wire 25C of the shielded cable 20 is connected to the ground pattern 31. The center conductor 21 and the shield wire 23 of the coaxial core 24 constituting the coaxial structure of the shielded cable 20 are placed on the ground pattern 31 so that the shield wire 23 is connected to the ground pattern 31 and the extending end of the center conductor 21 is connected to the connection land 33D.

In addition, the above-mentioned capacitor (not shown) for prevention of electrostatic discharge damage inserted between the movable terminal 7 and the tuner unit 121 can be substituted for the chip capacitor 36 which connects the connection land 33C and the connection land 33D. In this case, the extending end of the center conductor 21 constituting the coaxial structure of the shielded cable 20 is directly connected to the connection land 33C.

In the present embodiment, ferrite beads, for example, BLM18HD102SN1 (1608 size) manufactured by Murata Manufacturing Co., Ltd., are used as the high frequency chokes 35L, 35R and 35C. The high frequency chokes 35L, 35R and 35C using such beads provide low impedance for audio signals in the frequency band of not higher than 20 kHz, and provide high impedance for high frequency signals so as to prevent passage of the high frequency signals. Each of the chip capacitors 36L, 36R, 37L and 37R uses a type having a capacitance of 1,000 pF, and provides high impedance for audio signals in the frequency band of not higher than 20 kHz to prevent passage of the audio signals, and provide low impedance for high frequency signals. The high frequency chokes 35L, 35R and 35C and the chip capacitors 36L, 36R, 37L and 37R function as circuit devices for separating audio signals and high frequency signals.

When the earphone unit 40 is attached to the connection block 30, the earphone antenna 10 functions as a sleeve antenna which resonates at 100 MHz in the VHF band, because the two earphone cables 41 and 42, the meander-shaped pattern 60 on the connection block 30, the shield wire 23 of the coaxial core 24, and the signal wires 25L, 25R and 25C constitute such sleeve antenna. In addition, the earphone antenna 10 functions as a sleeve antenna of 1λ at 200 MHz, and can also make use of harmonic excitations of 100 MHz and 200 MHz (the third harmonic, the fifth harmonic and the seventh harmonic) in the UHF band.

In addition, in the earphone antenna 10, the earphone unit 40 can be removably attached to the connection block 30, and even when the earphone unit 40 is removed from the connection block 30, the meander-shaped pattern 60 on the connection block 30, the shield wire 23 of the coaxial core 24, and the signal wires 25L, 25R and 25C function as the sleeve antenna. In addition, receivable frequencies can be varied by adjusting the length of the meander-shaped pattern 60 formed to extend from the connection land 33C on the circuit board 34. In addition, it is possible to connect a coil to the connection land 33C instead of forming the meander-shaped pattern 60 on the circuit board 34, and in this case as well, it is possible to obtain a similar advantage.

The present invention can be applied to antennas other than the above-mentioned example, and can also be applied to a case where audio signals and high frequency signals are multiplexed in the earphone unit 40 and the shielded cable 20 is used to construct a dipole antenna.

Since the earphone unit 40 can be separated from the earphone antenna 10 at the pin jack connector 130 provided in the connection block 30, users can freely select desired earphone units as the earphone unit 40, so that it is possible to improve convenience of users who have found it inconvenient that the earphone unit 40 does not fit their ears.

Figure 8:
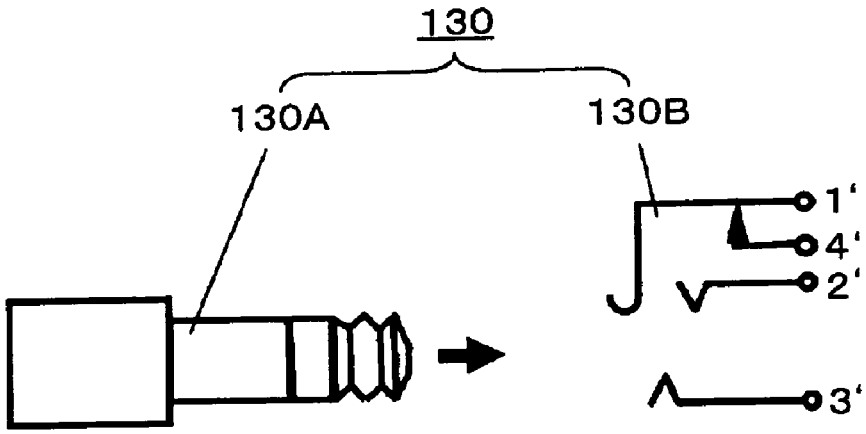
FIG. 8 is a schematic view showing another configuration example of the pin jack connector which connects the earphone unit to the earphone antenna of the liquid crystal television receiver.

In addition, since the earphone antenna 10 functions as an antenna even when the earphone unit 40 is removed, a jack having a mute terminal 4' may also be adopted as the connector jack 130B, as shown in FIG. 8, so that the headphone-detecting signal wire 25C can be connected to the mute terminal 4' of the connector jack 130B by a method similar to that used for each of the audio signal wires 25L and 25R. The mute terminal 4' contacts the ground terminal 1' when the earphone unit 40 is removed from the connection block 30. If this configuration is applied to a portable terminal having a mute function, the portable terminal can be configured to detect the presence or absence of earphones and reproduce sound from its built-in speaker during reception of television broadcasting.

Figure 9A:
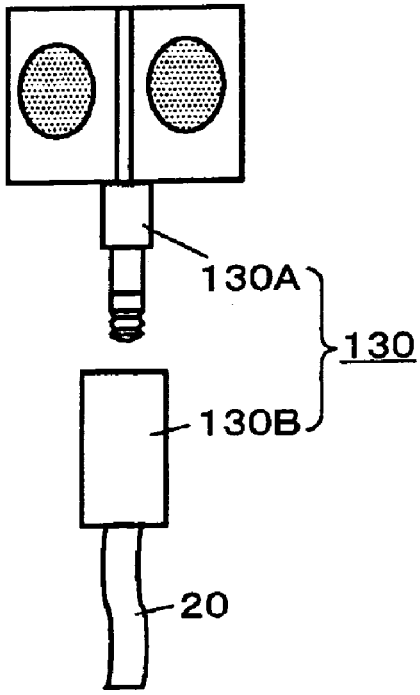
FIGS. 9A and 9B are schematic views showing a state (9A) in which an external speaker, instead of the earphone unit, is connected to the connection block via the pin jack connector, and a state (9B) in which a rod antenna, instead of the earphone unit, is connected to the connection block via the pin jack connector.

In addition, during the state shown in FIG. 9A, instead of the earphone unit 40, an external speaker 140 can be connected to the connection block 30 via the pin jack connector 130, so that the functions of both a speaker and an antenna can be satisfied even in the case of a portable terminal having no internal speakers.

Figure 9B:
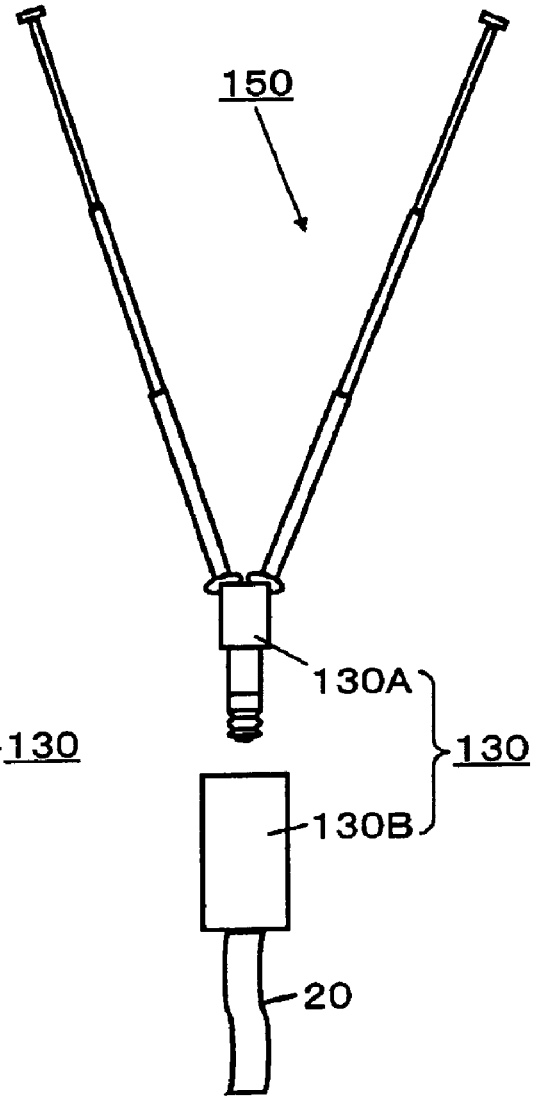

In addition, the earphone antenna 10 functions as a sleeve antenna irrespective of the presence or absence of the earphone unit 40, but during the state shown in FIG. 9B, instead of the earphone unit 40, a rod antenna 150 can be connected to the connection block 30 via the pin jack connector 130 so that the rod antenna 150, the meander-shaped pattern 60 on the connection block 30, the shield wire 23 of the coaxial core 24, and the signal wires 25L, 25R and 25C function as a sleeve antenna. In this case, sensitivity can be improved compared to the case where the earphone unit 40 is absent.

It should be understood by those skilled in the art that various modifications, combinations, sub-combinations and alterations may occur depending on design requirements and other factors insofar as they are within the scope of the appended claims or the equivalents thereof.

The invention claimed is:

1. An earphone antenna, comprising:

an earphone unit including an earphone, an earphone cable for supplying audio signals to the earphone, and a first pin jack connector portion on one end of the earphone cable, the earphone cable functioning as an antenna wire;

a shielded cable including a coaxial core, an insulation-coated signal wire for audio signals, and a ground wire, the coaxial core having a center conductor for transmitting high frequency signals surrounded by an insulator and further surrounded by a shield wire;

a multi-pole connector arranged on one end of the shielded cable and adapted to electrically connect the shielded cable to an electronic apparatus; and a connection block for connecting the other end of the shielded cable to the earphone unit, the connection block including a circuit device for separating audio signals and high frequency signals, and a second pin jack connector portion for removably receiving the first pin jack connector portion to removably connect the earphone unit to the connection block.

2. The earphone antenna according to claim 1, wherein the connection block includes an antenna device which functions as an antenna even when the earphone unit is disconnected from the connection block.

3. The earphone antenna according to claim 1, wherein the first and second pin jack connector portions together define a pin jack connector, the pin jack connector including a switch for opening a circuit in conjunction with an action of connecting the first pin jack connector portion to the second pin jack connector portion, and for closing the circuit in conjunction with an action of disconnecting the first pin jack connection portion from the second pin jack connection portion.

4. An electronic system, comprising:

a speaker;

a speaker cable for supplying audio signals to the speaker, the speaker cable functioning as an antenna wire;

a first pin jack connector portion on one end of the speaker cable;

a shielded cable including a coaxial core, an insulation-coated signal wire for audio signals, and a ground wire, the coaxial core having a center conductor for transmitting high frequency signals surrounded by an insulator and further surrounded by a shield wire;

a multi-pole connector arranged on one end of the shielded cable and adapted to electrically connect the shielded cable to an electronic apparatus; and a connection block for connecting the other end of the shielded cable to the speaker cable, the connection block including a circuit device for separating audio signals and high frequency signals, and a second pin jack connector portion for removably receiving the first pin jack connector portion to removably connect the speaker to the connection block.

5. An electronic system, comprising:

a rod antenna;

an antenna cable for supplying signals to the antenna, the antenna cable functioning as an antenna wire;

a first pin jack connector portion on one end of the antenna cable;

a shielded cable including a coaxial core, an insulation coated signal wire for audio signals, and a ground wire, the coaxial core having a center conductor for transmitting high frequency signals surrounded by an insulator and further surrounded by a shield wire;

a multi-pole connector arranged on one end of the shielded cable and adapted to electrically connect the shielded cable to an electronic apparatus; and a connection block for connecting the other end of the shielded cable to the rod antenna, the connection block including a circuit device for separating audio signals and high frequency signals, and a second pin jack connector portion for removably receiving the first pin jack connector portion to removably connect the rod antenna to the connection block.

* * * * *